US011149425B2

(12) United States Patent
Nelson

(10) Patent No.: US 11,149,425 B2
(45) Date of Patent: Oct. 19, 2021

(54) VENTILATED TOILET

(71) Applicant: Ventex Industries Ltd., Abbotsford (CA)

(72) Inventor: David Nelson, North Vancouver (CA)

(73) Assignee: Ventex Industries Ltd., Abbotsford (CA)

( * ) Notice: Subject to any disclaimer, the term of this patent is extended or adjusted under 35 U.S.C. 154(b) by 0 days.

(21) Appl. No.: 16/381,782

(22) Filed: Apr. 11, 2019

(65) Prior Publication Data

US 2019/0316335 A1 Oct. 17, 2019

Related U.S. Application Data

(60) Provisional application No. 62/656,547, filed on Apr. 12, 2018.

(51) Int. Cl.
*E03D 9/052* (2006.01)

(52) U.S. Cl.
CPC ..... *E03D 9/052* (2013.01)

(58) Field of Classification Search
CPC ..... E03D 9/052
USPC ..... 4/347–349
See application file for complete search history.

(56) References Cited

U.S. PATENT DOCUMENTS

| | | | | |
|---|---|---|---|---|
| 2,351,560 | A | 6/1944 | Thompson et al. | |
| 2,777,137 | A | 1/1957 | Mcfadden et al. | |
| 3,069,696 | A | 12/1962 | Howell et al. | |
| 3,230,552 | A | 1/1966 | Hugo et al. | |
| 3,495,282 | A | 2/1970 | Taggart et al. | |
| 3,938,201 | A | 2/1976 | McGrew | |
| 4,094,023 | A | 6/1978 | Smith | |
| 4,165,544 | A | 8/1979 | Barry | |
| 4,222,129 | A | 9/1980 | Baker | |
| 4,232,406 | A | 11/1980 | Beeghly | |
| 4,317,242 | A | 3/1982 | Stamper | |
| 4,402,091 | A | 9/1983 | Ellis | |
| 4,494,255 | A | 1/1985 | Drummond | |
| 4,620,329 | A | 11/1986 | Wix | |
| 4,989,276 | A | 2/1991 | Martens | |
| 2013/0086736 | A1 * | 4/2013 | Larouche | E03D 9/052 4/348 |

* cited by examiner

*Primary Examiner* — Tuan N Nguyen
(74) *Attorney, Agent, or Firm* — Dickinson Wright PLLC; Nicholas P. Coleman

(57) ABSTRACT

Please amend the abstract as follows: This invention relates to a ventilated toilet system for removing obnoxious odors from the toilet base and includes integral vent channels formed along the base and the back inside of the water tank, and a vent adapter mounted inside the passage that directs the flow of ventilating air along the vent channels to an exhaust pipe and discharges it by a remote in-line exhaust fan to the outside atmosphere. The adapter is attached to the base of the overflow flush valve pipe or, conversely, designed to be an integral part of the overflow flush value pipe, itself, and is positioned to connect the base vent channel of the water tank to the toilet water inlet chamber of the base for passage of ventilating air, and to connect the overflow flush valve pipe to the water inlet chamber for passage of flush water.

6 Claims, 4 Drawing Sheets

VENTILATED TOILET

This application claims the benefit of U.S. Provisional Application No. 62/656,547, the disclosure of which is incorporated by reference.

FIELD OF THE INVENTION

Embodiments of the present invention generally relate to toilets and more particularly toilets that are ventilated to remove odors.

BACKGROUND

The tendency in recent years towards closed rooms with air conditioning has brought about a change in the location of bathrooms, particularly in apartments, town houses, motels and hotels. Typically, in the past, bathrooms were often placed on an outside wall for ventilation to be obtained by means of a window. Recent designs to buildings places bathrooms within an interior of a building or living space in order to permit other living areas to be placed adjacent an exterior wall of the building or house, thus increasing the desirability of the living space. For those bathrooms placed within an interior space of a building or a living space, ventilation of odors from the bathroom is most often achieved by ceiling ventilation systems. That is, a ceiling vent sucks out air from the bathroom, through a conduit, and vents or exhausts bathroom air into the atmosphere. Accordingly, there is an increasing need for improved ventilation of the modern bathroom over the inefficient conventional method of ceiling vents.

Various types of devices for ventilating toilet bowls have been proposed and can be categorized into several groups according to their construction and mode of operation. A number of devices exist where the ventilation system is attached to the seat, is a part of the seat, or is built into the seat itself. Typical of these include: U.S. Pat. No. 4,620,329, which discloses a toilet having an internal channel in the seat for the conveyance of air through hollow hinge mechanisms; and U.S. Pat. No. 4,094,023, which discloses a toilet seat having a perforated suction tube attached on the underside and an exhaust tube running down that extends into the bowl. These ventilation systems can cause a sanitary problem due to the presence of baffles, channels and openings along the underside of the seat and/or tubing located in the bowl which present a breeding ground for bacteria.

Other devices exist in which the ventilation system is formed in the toilet bowl independent of the water tank, and these require reconstruction of the bowl itself as in U.S. Pat. Nos. 3,938,201 and 4,222,129. Once again unsanitary conditions are present.

Still other systems exist which are attached to the toilet bowl or hung on the side thereof such as in U.S. Pat. No. 4,317,242. These designs result in either an inconvenient or hazardous condition.

There are ventilating devices where the ventilation is achieved through the overflow pipe, such as is exhibited in U.S. Pat. Nos. 4,232,406, 4,165,544 and 3,495,282. These inventions all suffer from insufficient airflow volume to adequately ventilate the toilet.

Ventilating devices also exist that are positioned between the seat and the toilet bowl as exhibited in U.S. Pat. Nos. 3,069,696 and 4,402,091. These devices suffer from safety and sanitation problems due to the additional tubing and vents.

A few designs provide a ventilating system by adding a vent adapter between the toilet bowl and the water tank, all in communication with one another, as exhibited in U.S. Pat. Nos. 2,777,137, 3,230,552 and 4,494,255. Because the vent adapter is not an integral part of either the toilet bowl or the water tank, the device itself, as well as the crevices formed by the planes of connection, once again pose sanitation hazards and/or air flow constraints. Also, this exposed vent adapter is unsightly.

U.S. Pat. No. 2,351,560 uses a vent adapter positioned in the water inlet connecting the closet to the bowl but requires a major structural change in the configuration of the water tank to house a suction fan and motor assembly, and the motor wiring creates an electrical hazard.

In U.S. Pat. No. 4,989,276, a ventilated odorless toilet was disclosed comprising a toilet bowl having apertures along a bottom rim of the toilet for drawing odors from the toilet. The drawn odors were directed along a plurality of ventilation conduits within the water tank. The plurality of ventilations conduits were fluidly connected to a ventilation pipe or conduit disposed within the walls of the building and fluidly connected to a vent or exhaust opening in an exterior wall. The drawn odors are directed through the pipes and eventually exhausted into the atmosphere.

In general, the above ventilation systems have one or more of the following problems: inadequate sanitation, unsightly appearance, physical obstruction, electrical shock hazard, lack of plumbing code compliance and/or expense.

An objective of this invention is to provide a practical, durable, simple, inexpensive, and sanitary system of eliminating unwanted odors from the bathroom in an energy efficient manner that can be adapted to work with toilets already installed in buildings. Energy loss is additionally minimized by providing a relatively short interval of exhaust fan operation as compared to the prolonged usage of a less efficient bathroom fan.

SUMMARY OF THE INVENTION

An improved ventilated toilet can comprise a toilet base having flush water apertures spaced around the inner periphery of the toilet base rim of a conventional stool type toilet can be used to draw off odors in the opposite direction of water flow. These odors then pass through a tank vent channel that is placed between the toilet base and the water tank. The tank vent channel is fluidly connected to a ventilation conduit which can be fluidly connected to the outside atmosphere. The tank vent channel and the water tank are fluidly sealed to one another using a rubber gasket and a connector body having enlarged vent channels.

A flapper valve can be adapted to work cooperatively with the connector body and a trip lever can be adapted to work cooperatively with the flapper valve.

A flapper valve can be adapted to work cooperatively with the flush valve and a trip lever can be adapted to work cooperatively with the flapper valve.

Once the odors pass through the vent channel in the base of the water tank, the air flow proceeds up a vent channel provided along the back of the water tank and out through an opening port in the back of the tank that in turn communicates with a vent pipe having an in-stream exhaust fan mounted at a remote location.

Thus, in some embodiments, the invention provides an improved ventilated toilet, comprising: a water tank, the water tank configured to contain a volume of water that can be released by a user; base, wherein the base comprises a water inlet chamber, and at least one water channel, the water inlet chamber and the at least one water channel being fluidly connected to the water tank and configured to channel water into the base when the volume of water in the water tank is released by the user, and to provide an conduit for odors present in the base to be removed from the base; a ventilation conduit, the ventilation conduit providing a passage for odors present in the toilet to be removed from the base to the atmosphere outside an enclosure in which the ventilated toilet is situated; wherein the water tank further comprises: a fluid chamber, the fluid chamber configured to hold the volume of water; a vent channel, the vent channel comprising a ventilation cavity, the ventilation cavity configured to provide a conduit between the base and the ventilations conduit, operative to remove odors present in the ventilated toilet; a flush valve, the flush valve secured to the fluid chamber and moveable between a closed position and an open position, such that when the flush valve is in the closed position, the volume of water in the fluid chamber is substantially prevented from flowing into the base, and wherein when the flush valve is in the open position substantially the entire volume of water in the water tank is released into the base; a connector body, the connector body providing a fluid connection between the flush valve and the base, and further providing atmospheric communication of the base with the vent channel and ventilation conduit; an actuator, the actuator comprising a trip lever configured to move the flush valve from the closed position to the open position, thereby permitting water to be released from the water tank into the base.

In some embodiments, the flush valve comprises a flapper valve, the flapper valve moveable from the closed position to the open position by the actuator, and wherein the flapper valve returns to the closed position in response to gravity as the water in the fluid chamber is released into the water inlet chamber.

In some embodiments the connector body further comprises at least one vent, the at least one vent in atmospheric communication with the ventilation cavity and the base.

In some embodiments, the connector body further comprises a gasket, the gasket operative to secure the connector body to the water inlet channel.

In some embodiments, the ventilation conduit further comprises a fan, the fan operative to draw odors from the base through the ventilation conduit and to expel the odors into the atmosphere outside the enclosure in which the ventilated toiled is situated. In some embodiments, the fan is configured to operate continuously.

In some embodiments, the fan is activated directly by a user. In some embodiments, the fan is activated by movement of the actuator. In some embodiments, the actuator further comprises a timer operative to stop the operation of the fan after a pre-determined period of time.

In some embodiments, odors are substantially removed from the base at a flow rate of 1.6 gallons per flush. In some embodiments, odors are substantially removed from the base at a flow rate of 1.3 gallons per flush. In some embodiments, odors are substantially removed from the base at a flow rate of 0.8 gallons per flush

BRIEF DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numerals, and where:

DETAILED DESCRIPTION OF THE INVENTION

Figure 1:
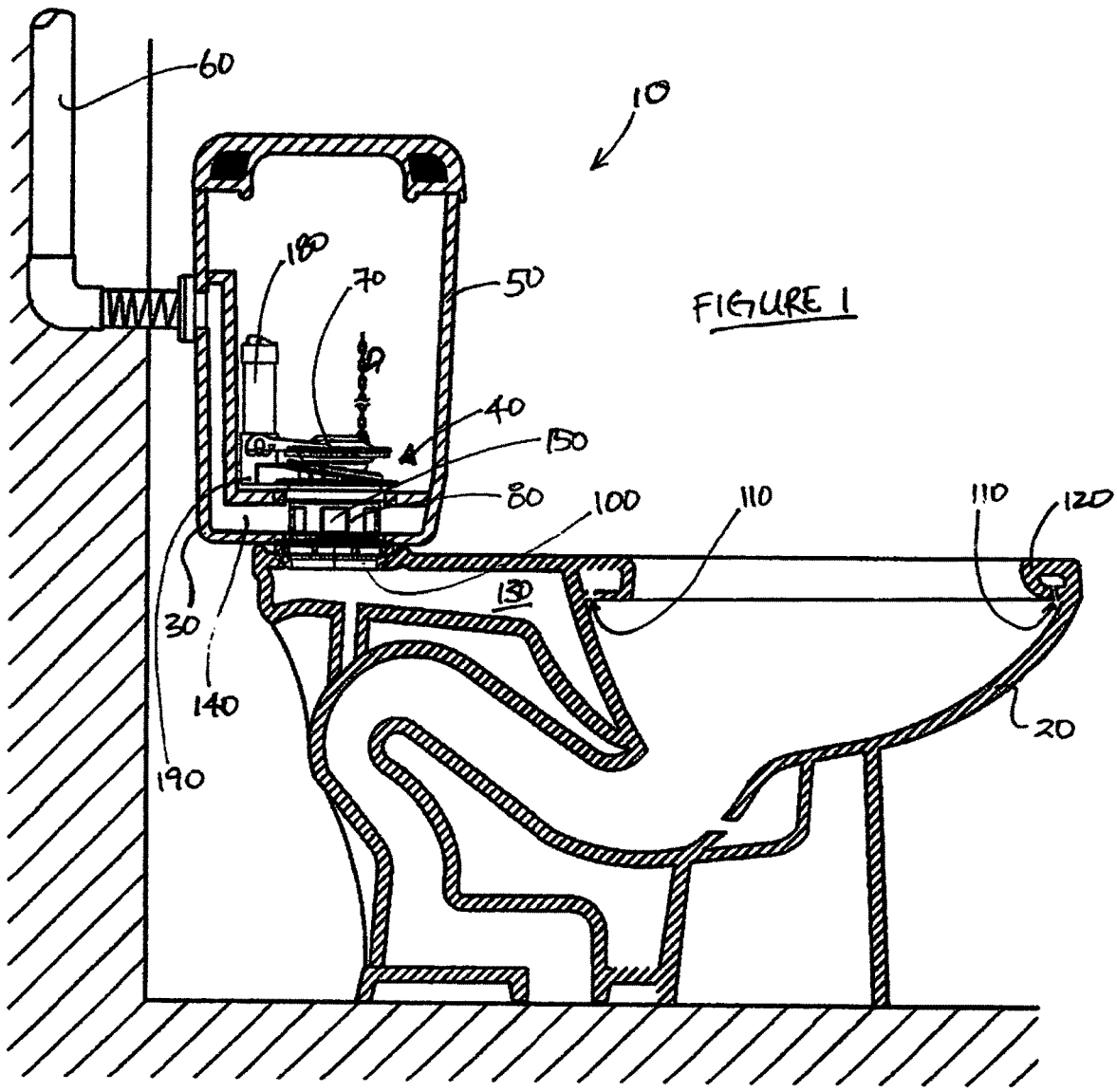
FIG. 1 is a side cross-sectional view of an embodiment of the present invention illustrating a siphon base, a tank vent channel, a water tank, connector body, and a flapper valve.

With reference to FIG. 1, an embodiment of the present invention comprises an ventilated toilet base 10 comprising a base 20, a tank vent channel 30, connecting means 40 for sealingly and fluidly connecting a water tank 50 to the base 20, and conduit means for fluidly connecting the tank vent channel 30 to a ventilation conduit 60. The base 20 can be adapted to be secured to a floor using known techniques, such as a base flange (not shown). The ventilated toilet provides an advantage over prior art apparatus in that it draws odors from the toilet and removes them to the atmosphere outside the enclosure where the toilet is situated.

To ensure that the water tank 50, the tank vent channel 30 and the base 20 are all fluidly sealed together, connecting means 40 can be used. In one embodiment, and as shown in FIG. 1, the connecting means 40 can comprise a flush valve 70 operatively connected to a connector body 80 having enlarged vent channels 150. The flush valve 70 is shown as a flapper valve.

As shown, the flush valve 70 is positioned within the water tank 50 and is operatively connected to the connector body 80 which spans the width of the tank vent channel 30 to extend into the base 20. A rubber gasket 100 can be used to secure and seal the connector body 80 to the base 20, and fluidly connect the base 20 to the vent channel 30 and the water tank 50.

The bowl 20 further comprises at least one water channel 110, which in some embodiments can be located along an underside of the top circumferential ring 120 of the base 20. In action, the flushing of the toilet typically causes water from the water tank 50 to flow through the connecting means 40 and into a water inlet chamber 130 and into the base 20 through the water channel 110.

The water channel 110 can also serve to function as vent apertures for odors within the base 20 to be exhausted through the water inlet chamber 130. As the odors collect within the water inlet chamber 130, the odors pass through the connector body 80 of the connecting means 40 and are directed into a ventilation cavity 140 of the vent channel 30 through enlarged vents 150.

The enlarged vents 150, are effective to permit operation of the system both with older versions of toilet installations, as well as with low flow and High Efficiency Toilet (HET) configurations that are designed to operate with reduced water volume per flush. For example, embodiments of the present system are effective to remove odors in toilet systems with flows of 1.6 gallons per flush (GPF), or lower. In some embodiments, the system is effective to remove odors in toilet installations with flows of about 1.3 GPF or lower. In some embodiments, the system is effective to remove odors in toilet installations with flows of 0.8 GPF or lower.

Figure 2:
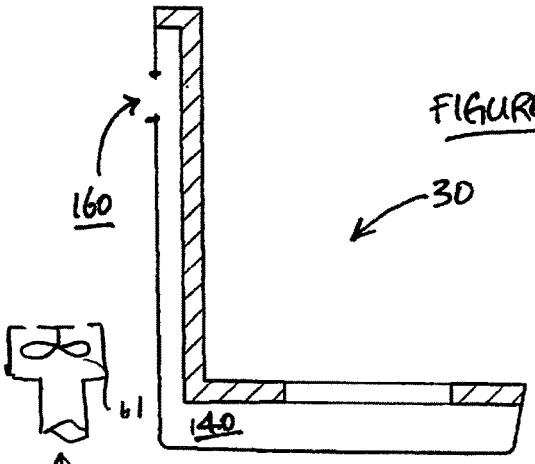
FIG. 2 is an enlarged side cross-sectional view of the tank vent channel of FIG. 1.

With reference to FIG. 2, the vent channel 30 has an opening 160 adjacent a top portion thereof which can be adapted to fluidly connect the ventilation cavity 140 to a pre-existing ventilation conduit 60.

The ventilation conduit 60 can be fluidly connected to the outside atmosphere using known techniques and also include a fan 61 to encourage and/or ensure consistent ventilation of odors from the toilet 10 and their movement to the atmosphere outside the enclosure where the toilet is situated.

Figure 3A:
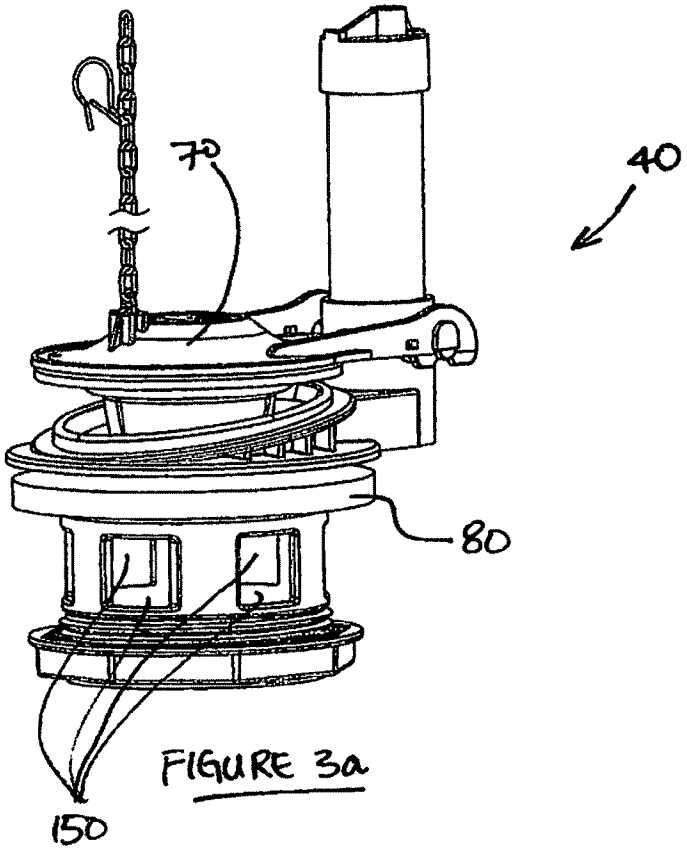
FIG. 3*a* is an enlarged side perspective view of the flapper valve and the connector body of FIG. 1.
Figure 3B:
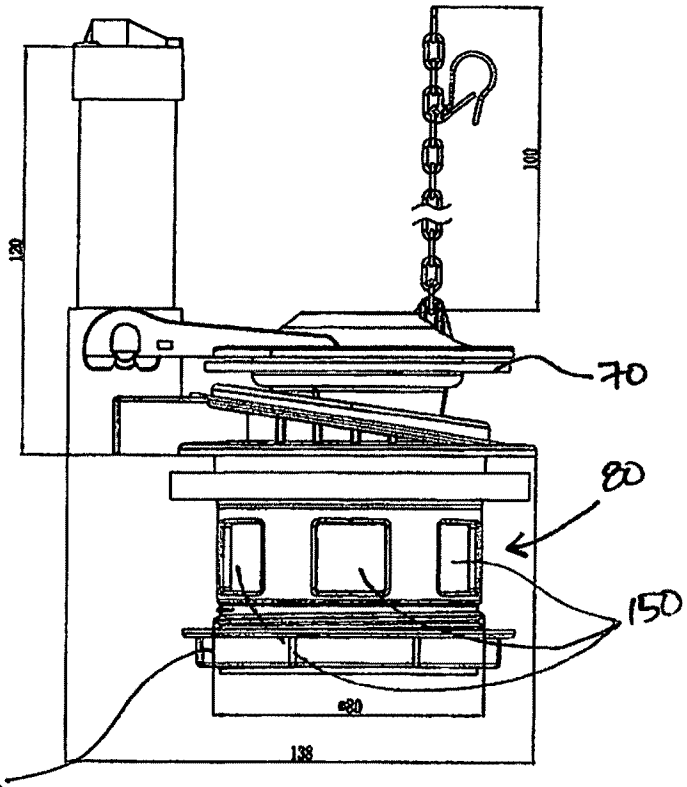
FIG. 3*b* is side view of the flapper valve and the connector body of FIG. 3*a;*
Figure 3C:
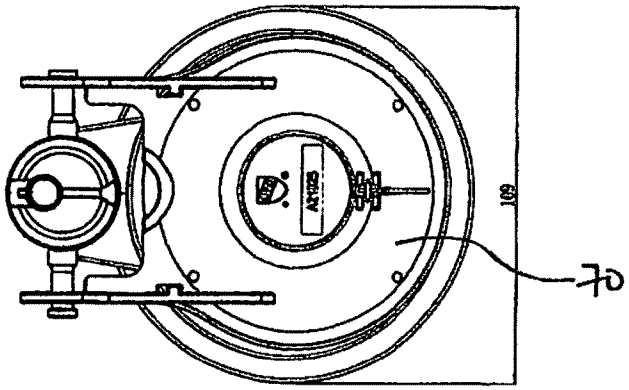
FIG. 3*c* is a plan view of the flapper valve and the connector body of FIG. 3*a;*

FIGS. 3*a* to 3*c* illustrate the connecting means 40 in greater detail. As shown, the flush valve 70 is adapted to be secured to a bottom portion of the water tank 50 by threaded connection to the connector body 80, which extends the width of the vent channel 30. Applicant notes that the enlarged vents 150 of the connector body 80 are aligned within the ventilation cavity 140 of the vent channel 30. As shown, a bottom portion of the connector body 80 extends beyond the vent channel 30 and is positioned with the water inlet channel 130 and secured thereto by a rubber gasket 100.

Figure 4A:
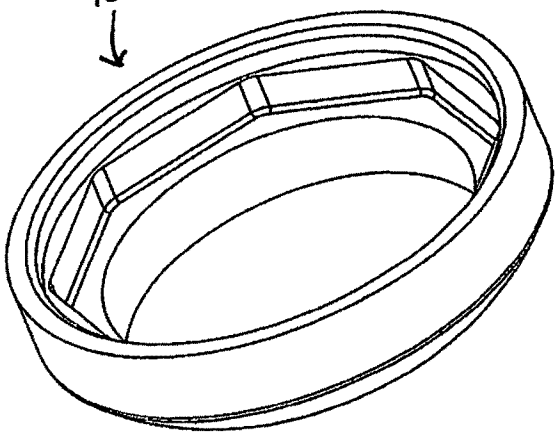
FIG. 4*a* is an enlarged side perspective view of an embodiment of the present invention illustrating a rubber gasket for sealing the tank vent channel to the toilet base and water tank of FIG. 1.
Figure 4B:
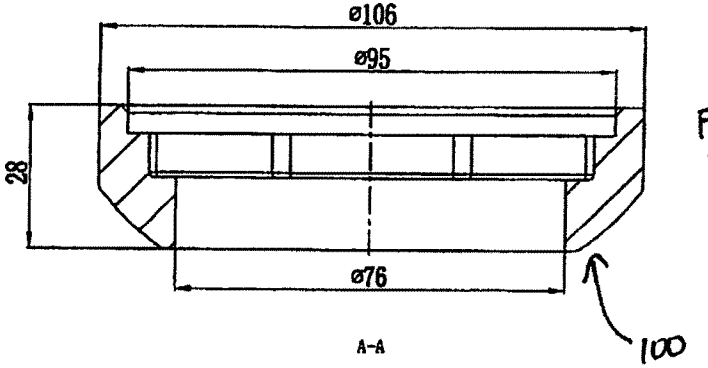
FIG. 4*b* is a side cross-sectional view of the rubber gasket of FIG. 4*a;*
Figure 4C:
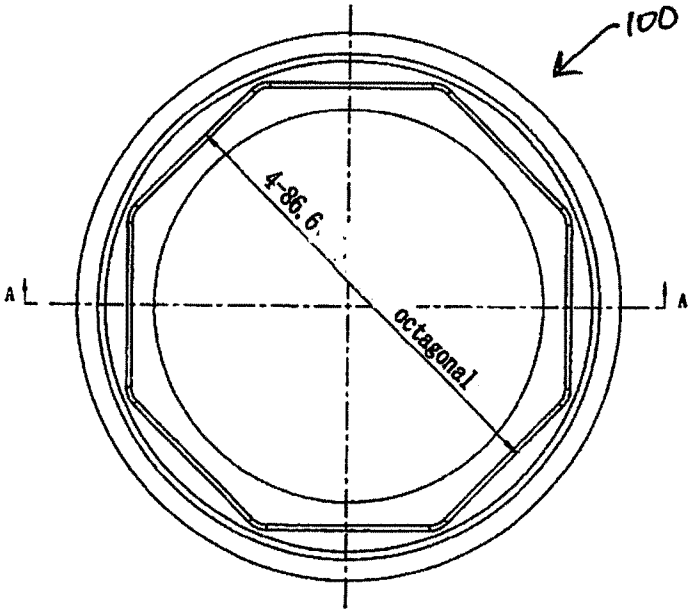
FIG. 4*c* is a plan view of the rubber gasket of FIG. 4*a;*
Figure 5D:
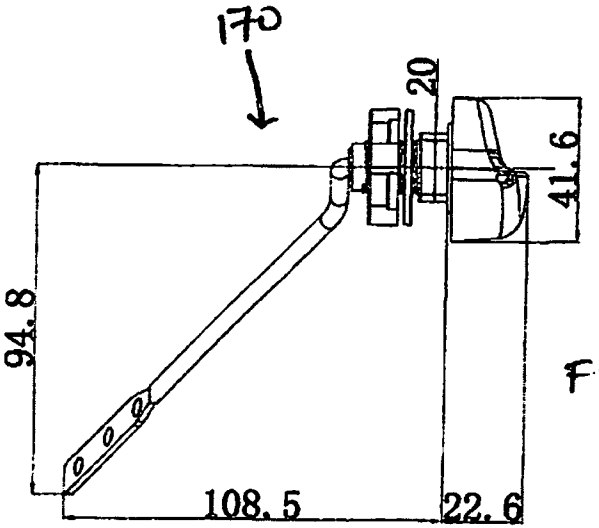
FIG. 5*d* is a rear view of the trip lever of FIG. 5*a*.
Figure 5A:
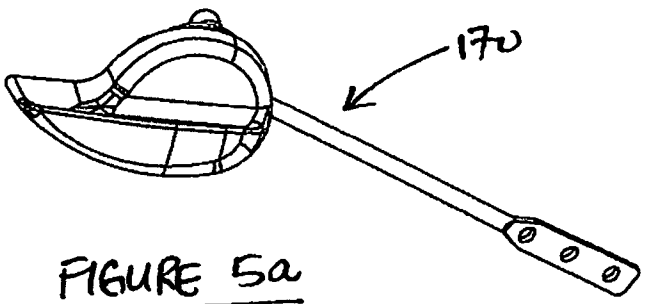
FIG. 5*a* is a side perspective view of an embodiment of the present invention illustrating a trip lever for use with the flapper valve of FIG. 1.
Figure 5B:
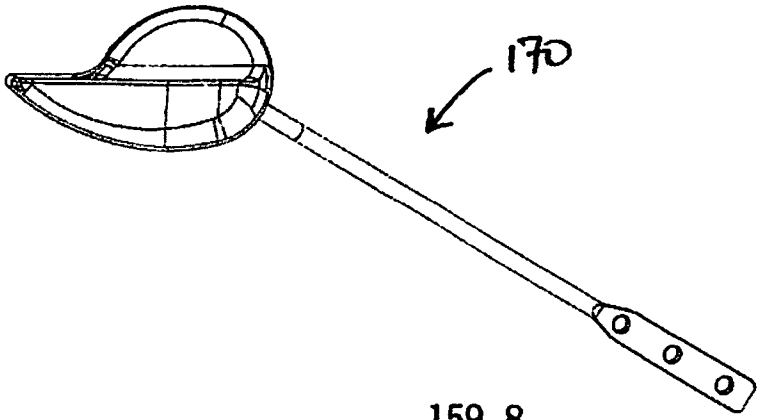
FIG. 5*b* is a side view of the trip lever of FIG. 5*a;*
Figure 5C:
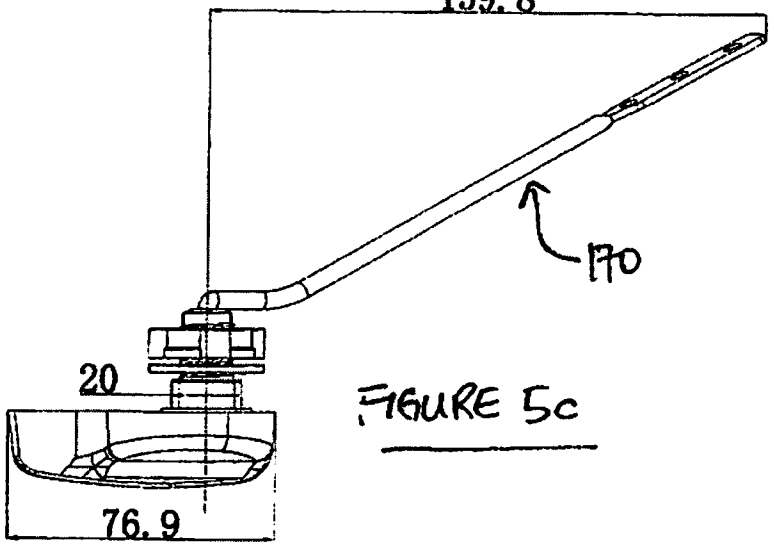
FIG. 5*c* is a plan view of the trip lever of FIG. 5*a*.

Embodiments of the rubber gasket 100 are shown in FIGS. 4*a* to 4*c*.

FIGS. 5*a* to 5*d*, inclusive, illustrate an embodiment of a trip lever 170 that can be adapted to be used with any pre-existing water tank. Referring back to FIG. 1, the trip lever 170 is operatively connected to a fill valve 180 that is fluidly connected to a water intake 190 along a bottom surface of the water tank 50 and operatively connected to the flush valve 70. By pushing down on the trip lever 170, the flush valve 70 is caused to be opened, allowing the water stored within the water tank 50 to escape through the connecting means 40 and into the base 20.

When the toilet is not being flushed, any odors within the base 20 passes through the water channels 110, into the water inlet chamber 130, through the enlarged vents 150 and into the ventilated cavity 140. From there a fan 61 will cause the odors to be fluidly moved through the ventilation conduit 60 and into the outside atmosphere.

In some embodiments, the fan can be configured to run continuously. In other cases, it may be desirable to activate the fan only when the ventilated toilet is in use, and possibly for a period of time afterwards. In this case the apparatus could include a switching mechanism to allow a user to turn the fan on and off as desired. In still other embodiments, operation of the fan may be link to the actuator assembly, such that when the toilet is flushed the fan is automatically started. In these cases, the system might also include a timer to turn the fan off again after a pre-determined length of time.

It will be recognized that the specific materials used in constructing the various components of the system described herein, are not considered to be limiting to the scope of the invention. Those of skill in the art will readily recognize and, be able to, select materials and components that will accomplish the objectives of the invention without requiring any inventive skill. It should also be apparent to those skilled in the art that many more modifications besides those already described are possible without departing from the inventive concepts herein. The inventive subject matter, therefore, is not to be restricted except in the scope of the appended claims.

Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Any reference or depiction of dimensions or relationships of the sizes of components of the system described herein are merely for illustrative purposes and are not to be construed as limiting in any way to the scope of the invention.

The invention claimed is:

1. An improved ventilated toilet for location within an enclosure and permitting egress of odors from within the toilet to the atmosphere outside of the enclosure via a ventilation conduit connected thereto, said toilet comprising:

a base comprising:

a water inlet chamber;

at least one water channel connecting the water inlet chamber and a water tank and configured to channel water into the base when released from the tank, as well as to provide an airflow conduit for odors present in the base to be removed from the base; and a sewer-connected bowl capable of flushing upon actuation of the toilet;

wherein the water tank comprises a unitary tank defining a fluid chamber to contain a volume of water that can be released by a user and further comprising an integral ventilation cavity defined by a cavity partition of at least partial tank width, said ventilation cavity extending from a tank discharge opening through the bottom of the tank to a ventilation discharge opening extending through the rear wall of the tank above a bottom of the tank and having a water inlet disposed above the tank discharge opening;

a flush valve having an intake and a discharge, wherein:

the flush valve is moveable between a closed position and an open position such that when the flush valve is in the closed position the water in the fluid chamber is substantially prevented from flowing and when the flush valve is substantially in the open position the volume of water in the fluid chamber is discharged from the flush valve;

the discharge of the flush valve comprises a tubular connector body of sufficient length to extend from the upper surface of the cavity partition to a bottom outer surface of the tank and is in sealed attachment to the cavity partition and an attachment face of the toilet base to retain the tank and base in relation to each other and define a fluid pathway connecting the discharge of the flush valve to the at least one water channel of the base;

said connector body further comprises a plurality of enlarged vents extending therethrough along the section disposed within the ventilation cavity, creating an atmospheric airflow pathway permitting airflow from at least one water channel of the base through the connector body into the ventilation cavity in the absence of water; and an actuator comprising a trip lever configured to move the flush valve from the closed position to the open position;

wherein;

the toilet comprises connection interfaces between the flush valve and the surface of the cavity partition and between the flush valve and the bottom outer surface of the tank, and wherein said connection interfaces are sealed whereby no odors can escape either seal into the enclosure; and upon connection of the ventilation discharge opening to the ventilation conduit the toilet is connected to standard water and sewer services;

on operation of the actuator the volume of water contained within the tank will be discharged into the toilet base, resulting in a toilet flush; and at any time other than during flushing, odors within the base can be actively or passively discharged to the atmosphere outside of the enclosure by movement of said odors through the at least one water channel to the discharge end of the ventilation conduit wherein the ventilation conduit further comprises a fan operative to draw odors from the base through the ventilation conduit and to expel the odors outside the enclosure, and wherein the fan is activated by movement of the actuator; and wherein the actuator further comprises a timer operative to stop the operation of the fan after a pre-determined period of time.

2. The ventilated toilet of claim 1, wherein the flush valve comprises a flapper valve moveable from the closed position to the open position by the actuator, and wherein the flapper valve returns to the closed position in response to gravity as the water in the fluid chamber is released into the water inlet chamber.

3. The ventilated toilet of claim 1, wherein the connector body further comprises a gasket operative to secure the connector body to the base.

4. The ventilated toilet of claim 1, wherein odors are substantially removed from the base at a flow rate of 1.6 gallons per flush.

5. The ventilated toilet of claim 1, wherein odors are substantially removed from the base at a flow rate of 1.3 gallons per flush.

6. The ventilated toilet of claim 1, wherein odors are substantially removed from the base at a flow rate of 0.8 gallons per flush.

* * * * *